US005251558A

United States Patent [19]

Bekins et al.

[11] Patent Number: 5,251,558

[45] Date of Patent: Oct. 12, 1993

[54] UNDERWATER SALVAGE APPARATUS

[76] Inventors: Ward J. Bekins, 1419 Nob Hill Ave. N., Seattle, Wash. 98109; Sylvester Wilson, 607 - 91st SW., Everett, Wash. 90204

[21] Appl. No.: 888,133

[22] Filed: May 26, 1992

[51] Int. Cl.[5] ..... B63C 7/00

[52] U.S. Cl. ..... 114/52

[58] Field of Search ..... 114/49-53

[56] References Cited

U.S. PATENT DOCUMENTS

| | | |
|---|---|---|
| 78,625 | 6/1868 | Walker . |
| 112,214 | 2/1871 | Brewer . |
| 1,368,787 | 2/1921 | De Graff . |
| 1,492,614 | 5/1924 | Tworski . |
| 2,179,125 | 11/1939 | Kirlin . |
| 2,707,846 | 5/1955 | Beseler . |
| 3,019,754 | 2/1962 | Welshausen . |
| 3,042,441 | 7/1962 | Jeffs et al. . |
| 3,339,965 | 9/1967 | Berns . |
| 3,358,884 | 12/1967 | Link . |
| 4,756,567 | 7/1988 | Nilson . |
| 4,832,391 | 5/1989 | Moell . |
| 4,979,451 | 12/1990 | Searle . |
| 5,094,181 | 3/1992 | Fuerst . |

FOREIGN PATENT DOCUMENTS 546162 8/1922 France ..... 114/52

*Primary Examiner*—Jesus D. Sotelo

*Attorney, Agent, or Firm*—Graybeal Jackson Haley & Johnson

[57] ABSTRACT

An underwater salvage apparatus is disclosed. The apparatus (includes a harness adapted to be oriented on) a substantially cylindrical drum having an air inlet and a water vent. The harness comprises a plurality of spaced longitudinally extending straps, having upper ends interconnected at the top of the drum. A ring adjacent these upper ends allows fastening of the harness to another harness by a line. Each of the longitudinally extending straps has a lower free end adapted to be disposed below the drum, and each of the lower free ends has a ring for securing the free end to an object to be salvaged. The harness also includes at least one circumferentially disposed strap interconnecting the plurality of longitudinally extending straps. The circumferentially disposed strap has a pair of free ends, with a pair of rings on one of the free ends for tightening the harness onto the drum by securing the pair of free ends.

32 Claims, 3 Drawing Sheets

UNDERWATER SALVAGE APPARATUS

BACKGROUND OF THE INVENTION

The invention pertains to apparatuses for underwater salvage, and more specifically to harnesses for securing drums or the like which are employed to salvage sunken vessels by means of buoyancy.

Salvaging sunken vessels by attaching buoyant devices, such as air filled containers, thereto is well-known in the art. Specifically, U.S. Pat. No. 1,368,787 issued to Deoraff; U.S. Pat. No. 1,492,614 issued to Tworski; U.S. Pat. No. 3,019,754 issued to Welshausen; and U.S. Pat. No. 4,979,451 issued to Searle all disclose buoyant containers employed to salvage sunken objects. While the above patents generally disclose air filled containers employed in salvage operations, these patents do not provide a convenient means of attachment of the buoyant containers to the sunken object. Specifically, the Degraff patent requires extensive modification of a barrel to include U-guides so that cable can be strung therethrough in order to connect the barrel to the sunken vessel.

U.S. Pat. No. 3,358,884 issued to Link and U.S. Pat. No. 5,094,181 issued to Fuerst disclose other types of salvage devices in which buoyant objects are placed under a sunken or sinking craft.

Finally, U.S. Pat. No. 78,625 issued to Walker; U.S. Pat. No. 112,214 issued to Brewer; U.S. Pat. No. 2,707,846 issued to Besler; U.S. Pat. No. 3,042,441 issued to Jeffs, et al.; U.S. Pat. No. 3,339,965 issued to Berns; U.S. Pat. No. 4,756,567 issued to Nilson and U.S. Pat. No. 4,832,391 issued to Moell all teach harnesses which are employed to lift non-buoyant containers or the like, as opposed to a harness which is employed to lift another object with a buoyant drum.

A need thus exists for an underwater salvage apparatus in which a buoyant drum is conveniently connectable by a harness to the object to be salvaged.

A need exists for the above type of underwater salvage apparatus in which no modification of the drum is required for the harness to be attached thereto.

A need also exists for the above type of underwater salvage apparatus in which a plurality of the harnessed drums can be connected to form an integral salvage unit.

SUMMARY OF THE INVENTION

In accordance with the invention, a harness is adapted to be oriented on a substantially cylindrical drum having an air inlet and a water vent. The harness comprises a plurality of spaced longitudinally extending straps, having upper ends interconnected at the top of the drum. A ring adjacent these upper ends allows fastening of the harness to another harness by a line in order to form an integral salvage unit. Each of the longitudinally extending straps has a lower free end adapted to be disposed below the drum, and each of the lower free ends has a ring for securing the free end to an object to be salvaged. The harness also includes at least one circumferentially disposed strap interconnecting the plurality of longitudinally straps. The circumferentially disposed strap has a pair of free ends, with a pair of rings on one of the free ends for tightening the harness onto the drum by securing the pair of free ends.

Preferably the longitudinally extending straps of the harness are four in number, and there are two circumferentially disposed straps interconnecting the large longitudinally extending straps. Most preferably, the longitudinally extending straps and circumferentially disposed straps are comprised of a synthetic polymer, and are joined by stitching or riveting.

BRIEF DESCRIPTION OF THE DRAWINGS

The foregoing objects and attendant advantages of this invention will become more readily appreciated as the same become better understood by reference to the following detailed description when taken in conjunction with the accompanying drawings wherein.

DETAILED DESCRIPTION OF THE PREFERRED EMBODIMENT

Figure 1:
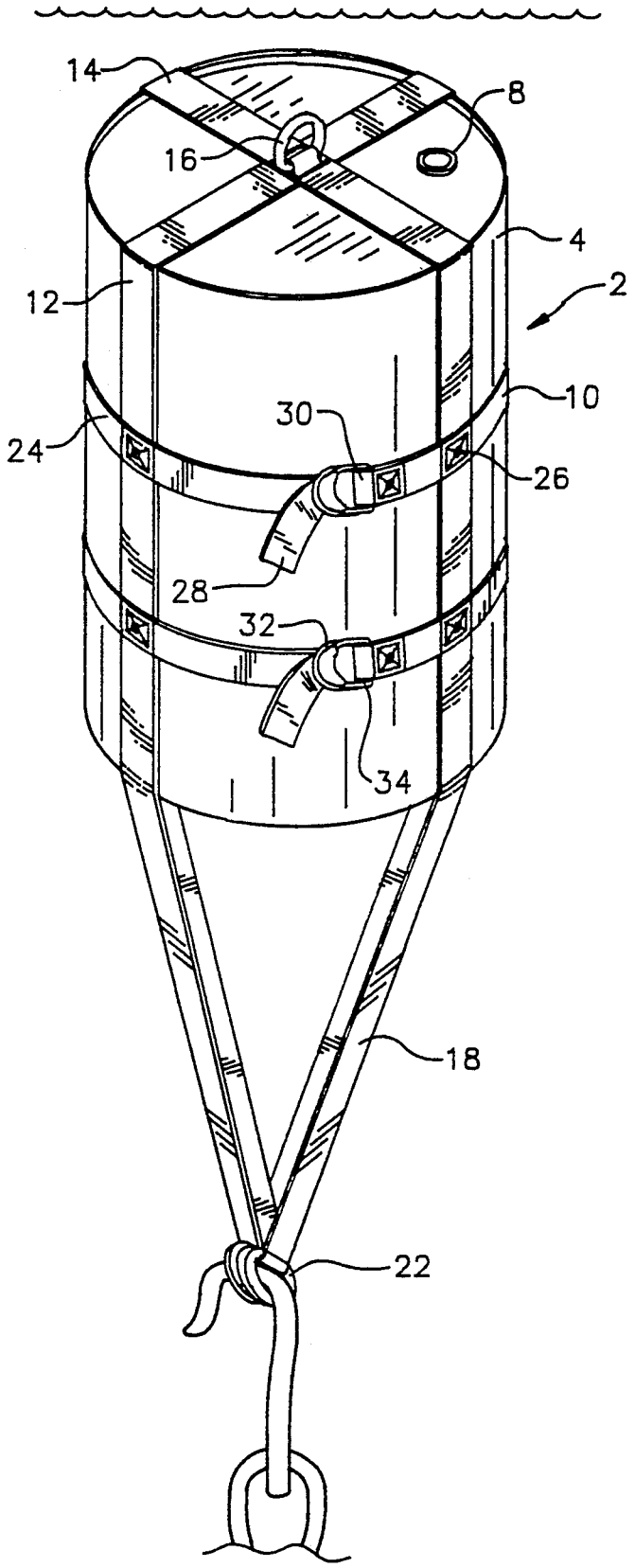
FIG. 1 is a perspective view of the underwater salvage apparatus of the present invention.
Figure 2:
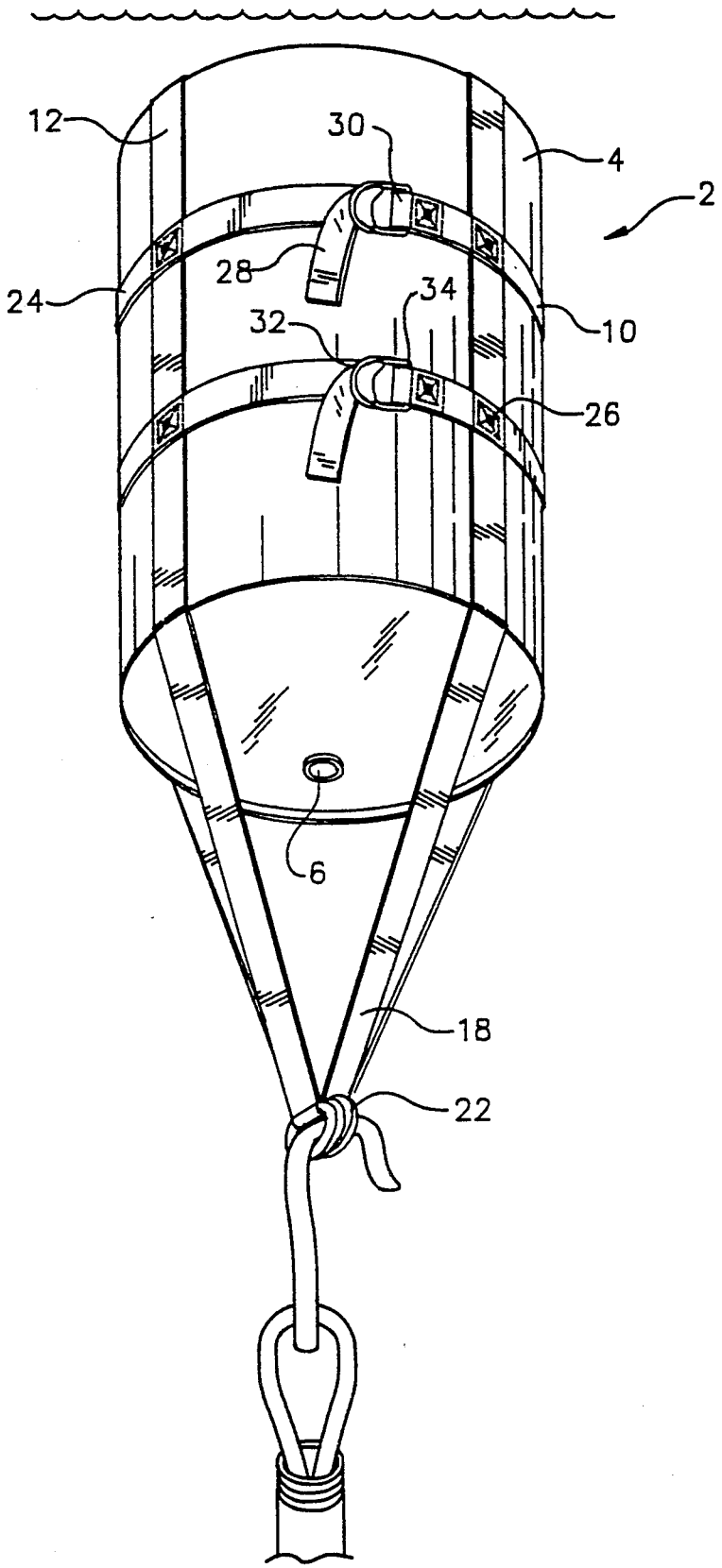
FIG. 2 is another perspective view of the underwater salvage apparatus of the present invention.

Referring to FIGS. 1 and 2, the present invention encompasses an underwater salvage apparatus comprised of a drum secured by a harness, and a harness adapted to secure a buoyant drum employed to salvage underwater objects. Underwater salvage apparatus 2 includes drum 4, which is a cylindrical container preferably comprised of a metal alloy or synthetic polymer. Drum 4 includes air inlet 6 and water vent 8 which allow submersion of the drum under water, and subsequent floatation thereof. More specifically, by opening both air inlet 6 and water vent 8, drum 4 can be submerged as water fills drum 4. After drum 4 has been submerged and is attached to the sunken object, as described below, drum 4 is filled with air from an air source such as an air pump or air tank (not shown) through air inlet 6. The water in drum 4 exits through water vent 8 as air enters. In this manner, the buoyancy of drum 4 can be employed to raise submerged objects. Air inlet 6 and water vent 8 can be, for example, coverable orifices, or, alternatively, valves known in the art.

Harness 10 is employed to secure drum 4 to the object to be salvaged. Harness 4 is preferably comprised of material consisting of a synthetic polymer. Harness 4 has a plurality of longitudinally extending straps 12, preferably four in number. Longitudinally extending straps 12 each have an upper end 14 which is interconnected with the other upper ends 14 such that each upper end 14 converges at the top of the drum 4. Upper fastening 16 is located adjacent the intersection of upper ends 14. Each of longitudinally extending straps 12 also has a lower free end 18 which extends below drum 4 such that drum 4 can be oriented a desired distance from the object to be lifted. Each of lower free end 18 includes a lower fastening ring 22 thereon. Thus, all of the lower free ends 18 of longitudinally extending straps 12 can be gathered such that the lower fastening rings 22 can be secured to the object to be salvaged by a hook, clasp or the like.

Harness 10 also includes at least one, and preferably two, circumferentially disposed straps 24 which are secured to longitudinally extending straps 12 by stitching or riveting 26. Each of circumferentially disposed straps 24 have free ends 28 and 30. Tightening rings 32 and 34 are located on one of two of free ends 28 and 30, and the other of free ends of 28 and 30 is placed through tightening rings 32 and 34 such that circumferentially disposed strap 24 can be cinched tightly around drum 4.

In operation, drum 4 is secured in harness 10 by placing drum 4 in harness 10 and tightening circumferentially disposed straps 24 as described immediately above. At this time, drum 4 will have been filled with sufficient water such that drum 4 has a substantially neutral buoyancy. Drum 4 is next maneuvered to the desired point of attachment of the object to be salvaged, and is attached thereto by gathering lower free ends 18 of longitudinally extending straps 12 such that lower fastening rings 22 can be secured to the object to be salvaged by means of a hook, clasp or the like as described above. Finally, drum 4 achieves a positive buoyancy by the addition of air thereto, and simultaneous voiding of water therefrom, through the above described use of air inlet 6 and water vent 8. It is readily apparent that the number of underwater salvage apparatuses 2 required to lift a submerged object from the water depends on factors which include the volume of each of drums 4 and the size and mass of the object to be salvaged.

Figure 3:
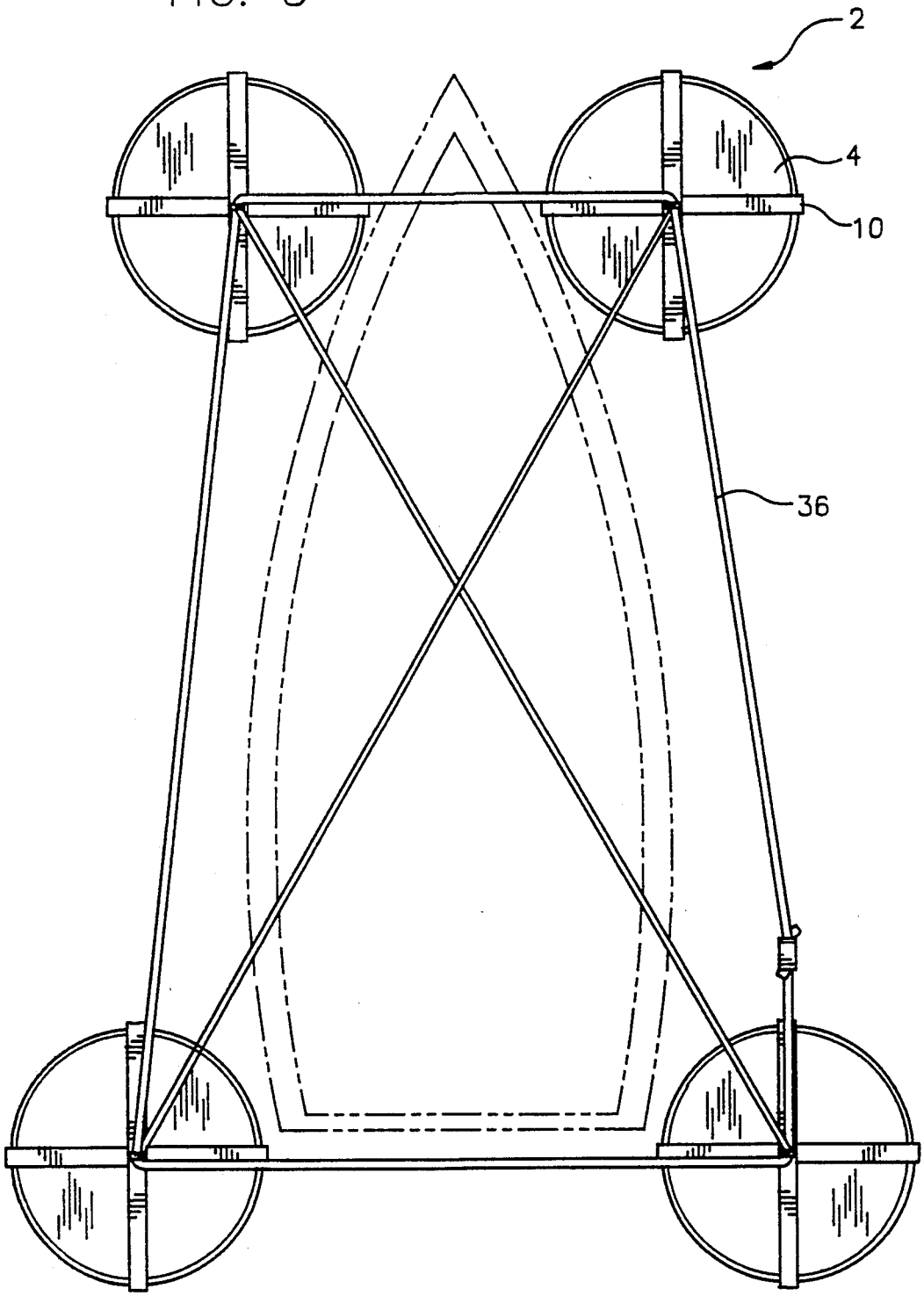
FIG. 3 is a top view of a plurality of underwater salvage apparatuses of the present invention interconnected into an integral unit.

Now referring to FIG. 3, a plurality of underwater salvage apparatuses 2 are shown which are interconnected in order to form an integral salvage unit. More specifically, upper fastening ring 16, which is located adjacent the intersection of upper ends 14 of longitudinally extending straps 12 is employed such that each underwater salvage apparatus 2 can be connected to the other underwater salvage apparatuses 2 by means of line 36 being connected to each upper fastening ring 16. In this manner, the buoyant forces supplied by the plurality of underwater salvage apparatuses 2 can be controlled, and more specifically, can be maintained in a substantially symmetrical manner such that excessive forces on specific areas of the object to be salvaged, which could result in damage to the object to be salvaged, are avoided. Additionally, the above described interconnection of underwater salvage apparatuses 2 ensures that substantially longitudinal buoyant forces are applied to the object to be lifted because the orientation of one or more underwater salvage apparatuses 2 that are attached to angled portions of the object to be lifted can be corrected by securing these underwater salvage apparatuses 2 to others.

While preferred embodiments of the invention have been illustrated and described, it will be appreciated that various changes can be made therein without departing from the spirit and scope of the invention.

I claim:

1. An underwater salvage apparatus comprising:.

a substantially cylindrical drum having a top and having an air inlet and a water vent; and a harness adapted to be oriented on said drum, said harness comprising:

a plurality of spaced longitudinally extending straps each having an upper end interconnected at said top of said drum by fastening means, each of said longitudinally extending straps having a lower free end adapted to be disposed below said drum, each of said lower free ends having a means for securing said free end to an object to be salvaged; and at least one circumferentially disposed strap interconnecting said plurality of longitudinally extending straps, said circumferentially disposed strap having a pair of free ends and having means for tightening said harness onto said drum by securing said pair of free ends.

2. The underwater salvage apparatus of claim 1 wherein said plurality of longitudinally extending straps are four in number.

3. The underwater salvage apparatus of claim 1 wherein two circumferentially disposed straps are present.

4. The underwater salvage apparatus of claim 1 further comprising means for fastening said harness to another harness, said means for fastening comprising:

a ring adjacent said upper ends of said longitudinally extending straps, said ring adapted to be secured to a line.

5. The underwater salvage apparatus of claim 1 wherein said means for securing each of said free ends of said longitudinally extending straps to an object to be salvaged is a ring.

6. The underwater salvage apparatus of claim 1 wherein said means for tightening said harness onto said drum is a pair of rings on one of said pair of free ends of said circumferentially disposed strap through which said other of said pair of free ends of said circumferentially disposed strap can be placed.

7. An underwater salvage harness comprising:

four spaced longitudinally extending straps each of said longitudinally extending straps having an upper end interconnected at the top of a drum, each of said longitudinally extending straps having a lower free end adapted to be disposed below a drum, each of said lower free ends having a ring for securing said free end to an object to be salvaged;

two circumferentially disposed straps interconnecting said four longitudinally extending straps, each of said circumferentially disposed straps having a pair of free ends and having a pair of rings on one of said free ends for tightening said harness onto a drum by securing said pair of free ends. and a ring adjacent said upper ends of said longitudinally extending straps, said ring adapted to be secured to a line to fasten said harness to another harness.

8. An underwater salvage harness comprising;

four spaced longitudinally extending straps each having an upper end interconnected at the top of a drum, each of said longitudinally extending straps having a lower free end adapted to be disposed below a drum, each of said lower free ends having a means for securing said free end to an object to be salvaged; and at least one circumferentially disposed strap interconnecting said plurality of longitudinally extending straps, said circumferentially disposed strap having a pair of free ends and having means for tightening said harness onto a drum by securing of said pair of free ends.

9. The underwater salvage harness of claim 8 wherein two circumferentially disposed straps are present.

10. The underwater salvage harness of claim 8 further comprising means for fastening said harness to another harness, said means for fastening comprising:

a ring adjacent said upper ends of said longitudinally extending straps, said ring adapted to be secured to a line.

11. The underwater salvage harness of claim 8 wherein said means for securing each of said free ends of said longitudinally extending straps to an object to be salvaged is a ring.

12. The underwater salvage harness of claim 8 wherein said means for tightening said harness onto a drum is a pair of rings on one of said pair of free ends of said circumferentially disposed strap through which said other of said pair of free ends of said circumferentially disposed strap can be placed.

13. An underwater salvage harness comprising:

a plurality of spaced longitudinally extending straps each having an upper end interconnected at the top of a drum, each of said longitudinally extending straps having a lower free end adapted to be disposed below a drum, each of said lower free ends having a means for securing said free end to an object to be salvaged; and two circumferentially disposed straps interconnecting said plurality of longitudinally extending straps, said circumferentially disposed strap having a pair of free ends and having means or tightening said harness onto a drum by securing of said pair of free ends.

14. The underwater salvage harness of claim 13 wherein said plurality of longitudinally extending straps are four in number.

15. The underwater salvage harness of claim 13 further comprising means for fastening said harness to another harness, said means for fastening comprising:

a ring adjacent said upper ends of said longitudinally extending straps, said ring adapted to be secured to a line.

16. The underwater salvage harness of claim 13 wherein said means for securing each of said free ends of said longitudinally extending straps to an object to be salvaged is a ring.

17. The underwater salvage harness of claim 13 wherein sadi means for tightening said harness onto a drum is a pair of rings on one of said pair of free ends of said circumferentially disposed strap through which said other of said pair of free ends of said circumferentially disposed strap can be placed.

18. An underwater salvage harness comprising:

a plurality of spaced longitudinally extending straps each having an upper end interconnected at the top of a drum, each of said longitudinally extending straps having a lower free end adapted to be disposed below a drum, each of said lower free ends having a means for securing said free end to an object to be salvaged;

at least one circumferentially disposed strap interconnecting said plurality of longitudinally extending straps, said circumferentially disposed strap having a pair of free ends and having means for tightening said harness onto a drum by securing of said pair of free ends; and a ring adjacent said upper ends of longitudinally extending straps, said ring adapted to be secured to a line.

19. An underwater salvage harness of claim 18 wherein said plurality of longitudinally extending straps are four in number.

20. The underwater salvage harness of claim 18 wherein two circumferentially disposed straps are present.

21. The underwater salvage harness of claim 18 wherein said means for securing each of said free ends of said longitudinally extending straps to an object to be salvaged is a rig.

22. The underwater salvage harness of claim 18 wherein said means for tightening said harness onto a drum is a pair of rings on one of said pair of free ends of said circumferentially disposed strap through which said other of said pair of free ends of said circumferentially disposed strap can be placed.

23. An underwater salvage harness comprising;

a plurality of spaced longitudinally extending straps each having an upper end interconnected at the top of a drum, each of said longitudinally extending straps having a lower free end adapted to be disposed below a drum, each of said lower free ends having a ring for securing said free end to an object to be salvaged; and at least one circumferentially disposed strap interconnecting said plurality of longitudinally extending straps, said circumferentially disposed strap having a pair of free ends and having means for tightening said harness onto a drum by securing of said pair of free ends.

24. The underwater salvage harness of claim 23 wherein said plurality of longitudinally extending straps are four in number.

25. The underwater salvage harness of claim 23 wherein two circumferentially disposed straps are present.

26. The underwater salvage harness of claim 23 further comprising means for fastening said harness to another harness, said means for fastening comprising:

a ring adjacent said upper ends of said longitudinally extending straps, said ring adapted to be secured to a line.

27. The underwater salvage harness of claim 23 wherein said means for tightening said harness onto a drum is a pair of rings on one of said pair of free ends of said circumferentially disposed strap through which said other of said pair of free ends of said circumferentially disposed strap can be placed.

28. An underwater salvage harness comprising;

a plurality of spaced longitudinally extending straps each having an upper end interconnected at the top of a drum, each of said longitudinally extending straps having a lower free end adapted to be disposed below a drum, each of said lower free ends having a means for securing said free end to an object to be salvaged; and at least one circumferentially disposed strap interconnecting said plurality of longitudinally extending straps, said circumferentially disposed strap having a pair of free ends and having a pair of rings on one of said pair of free ends of said circumferentially disposed strap for tightening said harness onto a drum by securing of said pair of free ends.

29. The underwater salvage harness of claim 28 wherein said plurality of longitudinally extending straps are four in number.

30. The underwater salvage harness of claim 34 wherein two circumferentially disposed straps are present.

31. The underwater salvage harness of claim 28 further comprising means for fastening said harness to another harness, said means for fastening comprising:

a ring adjacent said upper ends of said longitudinally extending straps, said ring adapted to be secured to a line.

32. The underwater salvage harness of claim 28 wherein said means for securing each of said free ends of said longitudinally extending straps to an object to be salvaged is a ring.

* * * * *